United States Patent [19]

Hardymon

[11] Patent Number: 4,467,865

[45] Date of Patent: Aug. 28, 1984

[54] WELL PACKER PROVIDED WITH DUAL METHODS OF USE

[76] Inventor: Mark Hardymon, 7981 Perry Rd., Delaware, Ohio 43015

[21] Appl. No.: 481,133

[22] Filed: Apr. 1, 1983

[51] Int. Cl.[3] ..... E21B 33/124

[52] U.S. Cl. ..... 166/102; 166/191; 277/34

[58] Field of Search ..... 166/102, 130, 120, 183, 166/191, 186–188; 277/34.3, 34.6, 32, 34

[56] References Cited

U.S. PATENT DOCUMENTS

| | | | |
|---|---|---|---|
| 2,231,282 | 2/1941 | Norris | 166/187 |
| 2,288,233 | 6/1942 | Every | 166/102 |
| 2,544,212 | 3/1951 | Bayless et al. | 277/32 |
| 2,629,446 | 2/1953 | Freeling et al. | 277/34 |
| 2,650,546 | 9/1953 | Pankratz | 277/34 |
| 2,818,120 | 12/1957 | Whitton | 277/34 |
| 3,199,900 | 8/1965 | Baer | 277/34 |
| 3,456,725 | 7/1969 | Hatch | 166/187 |

*Primary Examiner*—Ernest R. Purser
*Assistant Examiner*—Thuy M. Bui
*Attorney, Agent, or Firm*—John L. Gray

[57] ABSTRACT

A low-cost, easily operable oil well packer is disclosed comprising two, spaced, circular restrainers attached to a producing casing section and connected by a hollow, flexible, cylindrical member surrounding the production casing section. The restraining members are provided with removable valve openings which are normally sealed and adjacent thereto and spaced between the threaded ends of the production casing section and the restraining members are additional valve openings which are also normally closed so that the well packer may be actuated by means of fluid pressure introduced by means of a connection from the interior of the production casing section or by means of an exterior hose.

6 Claims, 4 Drawing Figures

WELL PACKER PROVIDED WITH DUAL METHODS OF USE

BACKGROUND OF THE INVENTION

In the process of drilling oil and gas wells and recovering oil and gas from such wells, in many geological formations it is necessary to isolate the zone containing the oil and gas producing formation from the balance of the underground structure so as to prevent contamination of the oil and gas producing zone from salt water or other undersirable contaminants.

Historically this has been accomplished by the installation of packers in the well which expand to isolate the oil and gas producing zone and are placed above and below it or, if the producing zone is near the bottom of the well, it may only be necessary to place one packer above the producing zone. Such packers are based on mechanical means to set or retrieve the packer, which mechanical means in turn are actuated by the weight of the casing or by hydraulic force.

In the former case, the packer is set when shear pins which hold it away from the interior surface of the well bore are ruptured by the weight of the casing, thus forcing the packer to be compressed together and forcing a resilient section outward thereby sealing the production casing against either the outer casing or the well bore.

A common problem with the use of such mechanical actuated packers is that when the well bore is not straight or an obstruction is encountered the weight of the casing can shear the pins and set the packer prematurely.

This drawback is overcome in the second category of packers where the weight of the casing is not utilized to rupture shear pins but instead hydraulic pressure is used, which hydraulic pressure is applied to activate a mechanical device within the packer system in order to rupture the shear pins and thus set the packer in place.

Examples of this latter-type of packer are set forth in U.S. Pat. Nos. 3,239,008, Leutwyler, 3,374,838, Current, 4,018,272, Brown, et al., and 4,237,979, Weise. In each of these references hydraulic pressure is used to actuate a mechanical device which in turn permits the appropriate resilient member to be forced against the other casing or well bore. For example, in the case of U.S. Pat. No. 4,018,282, Brown, et al., hydraulic pressure in used to rupture shear pins which thus allow opposing portions of the packer to compress forcing a center rubber section outward, sealing against the outer casing or well bore. In U.S. Pat. No. 4,237,978, Weise, there are a series of slits which can be forced together when hydraulic pressure is applied which in turn forces a resilient device outward against the casing to function as a packer. In U.S. Pat. No. 3,374,838, Current, there are movable abutments which are expanded by hydraulic pressure. In all of the above examples there are mechanical parts within the packer which are activated by hydraulic pressure. All of these devices are complicated and thus relatively expensive because of the number of components which must be confined within a very small space. Furthermore, because of their complexity, these devices can malfunction very easily.

SUMMARY OF THE INVENTION

This invention relates to a novel oil well packer which, when positioned in place, is actuated by the application of fluid pressure directly to the packer. This packer is a very simple, uncomplicated device which utilizes flexible resilient hollow sections which may be expanded against the well bore or casing by means of fluid pressure.

It is therefore an object of this invention to provide a packer which is directly actuated by use of fluid pressure.

It is a further object of this invention to provide such a packer which is simple to install and economical to use.

It is a further object of this invention in one of its embodiments to provide such a packer which will permit the production casing section to be readily removed from the well sacrificing a portion of the packer in the process.

It is a still further object of this invention in another of its embodiments to provide such a packer which may be deflated and removed intact from the well casing.

This, together with other objects and advantages of the invention, should become apparent in the details of construction and operation as more fully described hereinafter and claimed, reference being had to the accompanying drawings forming a part hereof wherein like numerals refer to like parts throughout.

DETAILED DESCRIPTION OF THE INVENTION

Figure 1:
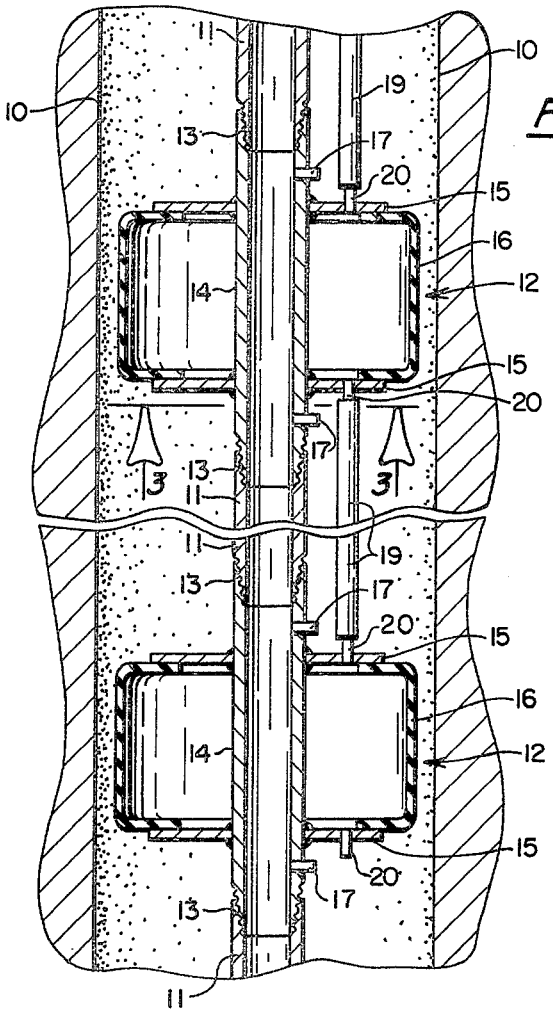
FIG. 1 is a side elevation sectional view showing a set of packers constituting one embodiment of the invention installed between the production casing section and the oil well bore with the packer bladders in unexpanded condition and the packer bladders connected together and to the surface by means of a hose exterior of said production casing section.
Figure 3:
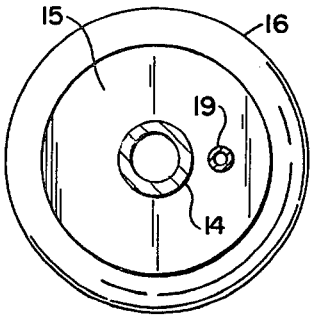
FIG. 3 is a view of the invention shown in FIG. 1 on section 3—3.
Figure 4:
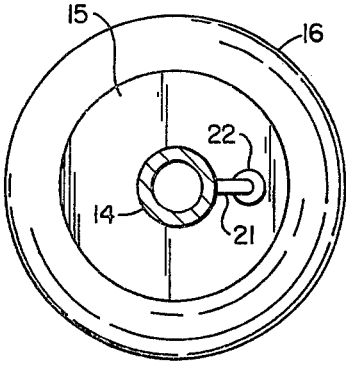
FIG. 4 is a view of the invention shown in FIG. 2 on section 4—4.
Figure 2:
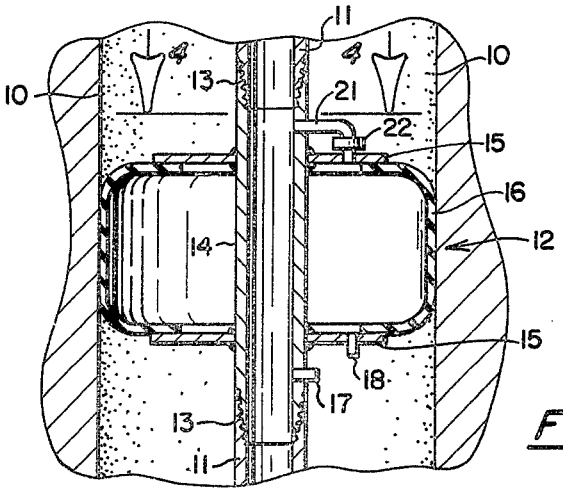
FIG. 2 shows one of the packers constituting another embodiment of the invention installed between the production casing section and the oil well bore with the packer bladder in expanded condition.

Referring now to the drawings, and more particularly to FIG. 1, there is shown the oil well bore 10—10 in which a production casing sections 11—11 has been positioned with two of the packers constituting the invention shown generally at 12—12, threaded into the production casing sections 11—11 by means of threaded ends 13—13 of the production casing sections 11—11. The packer 12 comprises a production casing section 14—14 to which circular metal restraining plates 15—15 are welded. The metal restraining plates 15—15 are connected together at their outer periphery by a hollow, cylindrical-shaped resilient member 16—16 which is molded to the surface of plates 15—15 near the outer edges thereof and completely surrounds the production casing section 14—14. The production casing section 14—14 is fitted with threaded removable plugs 17—17 which when removed will provide holes leading through the production casing section. These holes are located adjacent to the plates 15—15 and between the plates and the threaded ends 13—13 of the production casing section 14—14. Similar plugs 18—18 are provided in the plates 15—15 and one that has not been removed is shown in FIG. 2. The plugs 17—17 and 18—18 may be removed to accommodate either hoses as shown in FIG. 1 which are threadedly connected to valves 20—20 which have been inserted in the threaded holes after the plugs 18—18 have been removed, or may be utilized as shown in FIG. 2 which will be described later.

Referring now to the operation of the embodiment of the invention shown in FIG. 1, the packers 12—12 are positioned so that they are immediately above and below the production zone or if the production zone is near the base of the well, only one packer 12 may be utilized. If two the packers 12—12 are used, they are connected together by flexible hoses 19—19 and the upper packer is connected to an air or water pump on the surface by the well opening and the assembly is lowered into the well. When the assembly is properly positioned, air or water pressure is increased to at least 80 psi and preferably around 100 psi and this pressure is maintained so that the flexible portions 16—16 of the packers will be expanded against the well bore 10—10, thus effectively sealing off the oil and gas producing strata and preventing contamination from salt water and other contaminants. If it is desired to remove the packers from the well, the pressure is returned to atmospheric and the resilient members collapsed to the positions shown in FIG. 1 and the entire assembly may be removed from the well. Of course, the production casing section is perforated in the normal fashion in order to achieve flow of oil through the production casing section located between the packers 12—12.

Referring now to FIG. 2, there is shown another embodiment of this invention. In this case, the plug 18 in the upper portion of the packer 12 has been removed as has the plug 17 adjacent thereto in the production casing section 14 and the resulting opening have been connected together by a conduit 21 containing a check valve 22. In this case it is necessary to seal off the bottom end of the production casing section 11 and after the packer or packers have been properly positioned, either water or air is injected into the production casing section at a pressure of at least 80 psi and preferably around 100 psi, thus causing the hollow, cylindrical, resilent member 16 to expand against the well bore 10 and thus sealing off the production strata or zone. As shown in FIG. 2, the well packer 12 is shown in expanded position. The air pressure is relieved or, if water is used, the water is pumped out of the production casing section 11 and the production casing section 11 is perforated in the normal fashion and the well is put into production. In this embodiment of the invention, if it is necessary to remove the production casing section 11 from the well, this can be accomplished merely by pulling it upwardly. The bladders 16—16 will rupture allowing the easy removal of the casing and packer. Generally speaking, this embodiment of the packer would be used if the production zone were at a depth that was so great that it made the use of the hoses 19—19 impractical.

While this invention has been described in its preferred two embodiments, it is appreciated that variations thereon may be made without departing from the proper scope and spirit of the invention.

What is claimed is:

1. An oil well packer comprising:

a production casing section provided with threaded ends, two, spaced, flat, disc-shaped, circular restraining means surrounding and attached to said production casing section and extending at right angles from said production casing section, a hollow, flexible, cylindrical member attached to the periphery of each of said restraining means and spaced from and surrounding said production casing section, a first removable means for providing at least one opening into said production casing section on the surface thereof when said first removable means is removed from said production casing section, and a second removable means for providing at least one opening through at least one of said restraining means into said hollow, flexible cylindrical member when said second removable means is removed from said restraining means.

2. The oil well packer of claim 1 wherein the opening into said production casing section on the surface thereof and the opening into said hollow, flexible, cylindrical member are connected together by means of a conduit, said conduit including means to permit the flow of fluid from said production casing section into said hollow, flexible, cylindrical member and to prevent the flow of fluid from said hollow, flexible, cylindrical member into said production casing section.

3. The oil well packer of claim 1 wherein said opening through at least one of said restraining means into said hollow, flexible, cylindrical member is provided with a valve adapted to receive a hose.

4. The oil well packer of claim 1 wherein an opening is provided through each of said restraining means into said hollow, flexible, cylindrical member.

5. The oil well packer of claim 4 wherein an opening into said production casing section on the surface thereof is provided between each of said restraining means and the threaded end of said production casing section adjacent to said restraining means.

6. The oil well packer of claim 1 wherein an opening into said production casing section on the surface thereof is provided between said restraining means and said threaded end adjacent thereto.

* * * * *

UNITED STATES PATENT AND TRADEMARK OFFICE

CERTIFICATE OF CORRECTION

PATENT NO. : 4,467,865

DATED : August 28, 1984

INVENTOR(S) : Mark Hardymon

It is certified that error appears in the above-identified patent and that said Letters Patent is hereby corrected as shown below:

Column 1, line 46, "other" should read -- outer --.

Column 3, line 35, "opening" should read -- openings --.

Signed and Sealed this

*Sixteenth* Day of *April 1985*

[SEAL]

*Attest:*

DONALD J. QUIGG

*Attesting Officer*

*Acting Commissioner of Patents and Trademarks*